US005330093A

United States Patent [19]

Bottomley et al.

[11] Patent Number: 5,330,093

[45] Date of Patent: Jul. 19, 1994

[54] MANUFACTURE OF ARTICLES BY DIFFUSION BONDING AND SUPERPLASTIC FORMING

[75] Inventors: Ian Bottomley; Duncan Finch, both of Samlesbury, United Kingdom

[73] Assignee: British Aerospace Public Limited Company, London, England

[21] Appl. No.: 928,744

[22] Filed: Aug. 13, 1992

[30] Foreign Application Priority Data

Aug. 14, 1991 [GB] United Kingdom ..... 9117546

[51] Int. Cl.[5] ..... B23K 31/00

[52] U.S. Cl. ..... 228/157; 228/193; 228/262.71

[58] Field of Search ..... 228/155, 157, 118, 181, 228/193, 263.21, 262.71

[56] References Cited

U.S. PATENT DOCUMENTS

| | | | |
|---|---|---|---|
| 4,351,470 | 9/1982 | Swadling et al. | 228/157 |
| 4,406,393 | 9/1983 | Ascani, Jr. et al. | 228/157 |
| 4,577,797 | 3/1986 | Raymond | 228/157 |
| 4,603,089 | 7/1986 | Bampton | 228/157 |
| 4,732,312 | 3/1988 | Kennedy et al. | 228/157 |
| 4,820,355 | 4/1989 | Bampton | 228/157 |
| 5,115,963 | 5/1992 | Yasui | 228/157 |

FOREIGN PATENT DOCUMENTS 1429054 3/1976 United Kingdom .

OTHER PUBLICATIONS

Abstract of EPA 488592 Jun. 1992.
Abstract of EPA 445997 Sep. 1991.
Abstract of EPA 411926 Feb. 1991.
Abstract of EPA 399772 Nov. 1990.
Abstract of EPA 398760 Nov. 1990.
Abstract of EPA 350220 Jan. 1990.
Abstract of EPA 380336 Aug. 1990.
Abstract of EPA 328328 Aug. 1990.
Abstract of EPA 358523 Mar. 1990.
Abstract of EPA 356142 Feb. 1990.
Abstract of EPA 350329 Jan. 1990.
Abstract of GBA 2204108 Nov. 1988.
Abstract of GBA 2203376 Oct. 1988.
Abstract of EPA 266073 May 1988.
Abstract of GBA 2173511 Oct. 1986.
Abstract of EPA 194827 Sep. 1986.
Abstract of GBA 2167329 May 1986.
Abstract of EPA 181203 May 1986.
Abstract of EPA 161892 Nov. 1985.
Abstract of GBA 2144656 Mar. 1985.
Abstract of GBA 2129340 May 1984.
Abstract of GBA 2095604 Oct. 1982.
Abstract of GBA 2069391 Aug. 1991.
Abstract of GBA 2030480 Apr. 1980.
Abstract of GBA 1429054 Mar. 1976.
Abstract of GBA 1398929 Jun. 1975.

*Primary Examiner*—Samuel M. Heinrich
*Attorney, Agent, or Firm*—Cushman, Darby & Cushman

[57] ABSTRACT

Described herein is a method of manufacturing components having "warren girder" or "X" core structures, i.e. those having internal support walls extending between their outer surfaces, from superplastically formable and diffusion bondable materials having different flow stress characteristics. By using materials of relatively high flow stress characteristics for the outer skin sheets of the component, and relatively low flow stress characteristics to form the internal support walls, the tendency for the sheets outer skin to bow outwards during superplastic formation at a faster rate in regions where they are the greatest distance from support walls is reduced. Consequently, the exterior of the outer skin sheets is less susceptible to the formation of recesses thereon at the point where the corresponding interior surface meets the inner support walls, i.e. the phenomenon of quilting is substantially eliminated.

6 Claims, 2 Drawing Sheets

MANUFACTURE OF ARTICLES BY DIFFUSION BONDING AND SUPERPLASTIC FORMING

This invention relates to metal forming and more particularly to an improvement in the method of making articles having "warren girder" and "X" core structures by superplastic forming and diffusion bonding.

The term warren girder refers to structures having at least one sheet with a substantially planar portion from which strengthening walls extend at an angle thereto. Respective pairs of walls may be connected at their ends furthest from the sheet if there is only one sheet, and, if there are two sheets, then these ends may be connected to the second sheet. The term "X" core refers to structures similar to warren girder structures having pairs of walls which are connected as described above, but with additional pairs of strengthening walls which have connected ends which are joined to the connected ends of the other strengthening walls—the respective pairs of walls thus forming an "X" shape. Again, a second sheet may be included from which the unconnected ends of the additional strengthening walls extend.

As is well known in the field of metallurgy, superplastic forming is a process which makes use of the characteristics of certain metals, such as titanium and many of its alloys, which, when the metals are heated, allow them to be stretched and to undergo elongation of several hundred percent without necking. Such characteristics are referred to as superplasticity. This is due to the fine, uniform grain structure of such metals which, under load at high temperatures, allow grain boundary sliding by diffusion mechanisms so that the individual metal crystals slide relative to one another.

Diffusion bonding is often combined with superplastic forming to enable the manufacture of multi-sheet components of complex structure. The diffusion bonding process concerns the metallurgical joining of metals in contact by applying heat and pressure which results in the co-mingling of atoms at the joint interface, the interface as a result becoming metallurgically undetectable. It is often required that the metals are not bonded over the entire area of contact and in these circumstances bond inhibiting materials (commonly known as stop-off or stopping-off materials) are applied to selected areas by, for example, a silk screen printing process.

One known application of superplasticity is the formation of stiffened panels having warren girder or "X" core structures, by a method including the steps of positioning a metal face sheet on each side of an interior sheet of a metallic alloy having superplastic characteristics, attaching, preferably by a diffusion bonding technique, spaced regions of the interior sheet alternately to the face sheet on one side and to the face sheet on the other side of the interior sheet, bringing the assembly to within that temperature range at which the interior sheet exhibits superplastic characteristics, and injecting a gas, thereby causing the face sheets to be moved apart and thus to draw the attached regions of the interior sheet with them such that the said interior sheet finally extends from one face sheet to the other in alternate sequence. Such a method is described in our UK patent number 1,429,054.

FIGS. 1, 2 and 3 of the accompanying drawings illustrate a known three-sheet diffusion bonding and superplastic forming process for making a component having a warren girder internal structure. Three titanium alloy sheets 1, 2 and 3 are laid one on top of the other and selectively separated by a pattern of stop-off material (shown by bold lines 4) which leaves a grid of untreated areas where diffusion bonds (shown by the broken lines 5) in the final structure are required. The two outer sheets 1 and 3 will after formation become the skin of the component and are hereinafter referred to as skin sheets, whereas the inner sheet 2 will form the core or support walls of the component and is hereinafter referred to as the core sheet.

The three sheet "pack" comprising the overlaid core sheet 2, and skin sheets 1 and 3 is next subjected to pressure (as indicated by the straight arrows in FIG. 1) and high temperature (for example 930° C.), so that diffusion bonding occurs at the areas 5 untreated with stop-off, where bonding is not inhibited, and a "bonded" pack produced.

Where a plurality of components are to be manufactured in this way, a stack of three sheet packs, each separated from the next pack by a stop-off layer, may be subjected to the diffusion bonding pressure simultaneously. Thus, many bonded packs may be prepared in one operation. Bonded packs produced in this way may be stored for considerable time before the next stage in the process, the superplastic forming stage.

FIG. 2 shows a bonded pack undergoing the superplastic forming operation. The pack is clamped between two halves of a nickel chromium steel mould 6 heated to 930° C. An inert gas, indicated by the straight arrows, is introduced under pressure via a gas pipe connection 7 to regions between the sheets 1, 2 and 3 of the pack. As the inert gas is introduced, the sheets deform superplastically and bow out towards the inner mould surfaces to a partially formed position, as shown in FIG. 2. The core sheet 2 does not separate from the skin sheets 1 and 3 at the diffusion bonds 5. Eventually the pack superplastically deforms to produce a structure which substantially corresponds to the inner shape of the mould 6 and, because of the diffusion bonding of selected areas 5, the core sheet 2 forms supporting walls 8 at regular intervals throughout the structure, the walls 8 extending from one skin sheet to the other.

However, as is shown in FIG. 2, as the gas is introduced into the component, the skin sheets 1 and 3 tend to bow outwards at a faster rate in regions where they are the greatest distance from the support walls 8. Thus, the bowed-out regions come into contact with the interior surface of the mould 6 before the rest of the skin sheets 1 and 3 which results in excess stretching of the walls in the formed component at regions 9 (as shown in an exaggerated way by FIG. 3) where the support walls 8 join the core sheet 2. Thus, the exterior surface of the formed component does not completely conform to the interior surface shape of the mould 6.

This phenomenon is known as quilting. The uneven outer skin sheet 1 and 3 produced as a consequence is disadvantageous particularly for components which are to be used as aerodynamic surfaces.

A known method of overcoming this problem is to have a skin sheet to core sheet thickness ratio of, say, 3:1, (this ratio being dependent on the angle of the core sheets to the skin sheets in the formed component, and the amount of stress/stretching to which the core sheets are subjected) which reduces the tendency of the skin sheets 1 and 3 to bow out. However, it is then necessary to add an additional, onerous chemical milling step to the production process to reduce the thickness of the skin sheets 1 and 3 to that actually required for the component in use. The chemical milling step is time consuming, wasteful of materials and produces hazardous waste products.

It is an object of the invention to provide an improved method for reducing the problems associated with the above-described phenomenon of quilting.

According to the present invention there is provided a method of manufacturing a structure from at least two superplastically formable and diffusion bondable materials including the steps of diffusion bonding the respective two materials together in selected areas, and superplastically forming the diffusion bonded materials in a mould, and wherein the respective said at least two materials have different flow stress characteristics.

Preferably, three superplastically formable and diffusion bondable sheets of material are used to form the structure, two of the sheets having relatively high flow stress characteristics and forming in the manufactured structure respective outer surfaces thereof, and the other sheet having relatively low flow stress characteristics and on the manufactured structure extending between the said respective outer surfaces to form supporting walls thereof.

Alternatively, four superplastically formable and diffusion bondable sheets of material are used to form the structure, two of the sheets having relatively high flow stress characteristics and forming in the manufactured structures respective outer surfaces thereof, and the other two sheets having relatively low flow stress characteristics and each extending in the manufactured structure from one of the said respective outer surfaces to the other of said other two sheets to form supporting walls of said outer surfaces.

The two materials may have different chemical compositions to give them their different flow stress characteristics, or one or both of them may be processed, for example by heat treatment, to achieve this. Conveniently, the ratio of the different flow stress characteristics of the respective two materials is 3:1 or greater.

For a better understanding of the invention, an embodiment of it will now be described by way of example only and with particular reference to FIG. 4 of the accompanying drawings, in which:

Referring to FIG. 4, in which elements common to FIGS. 1-3 are designated by like numerals, the superplastic formation of a component having a warren girder internal structure is shown generally at 10.

Figure 1:
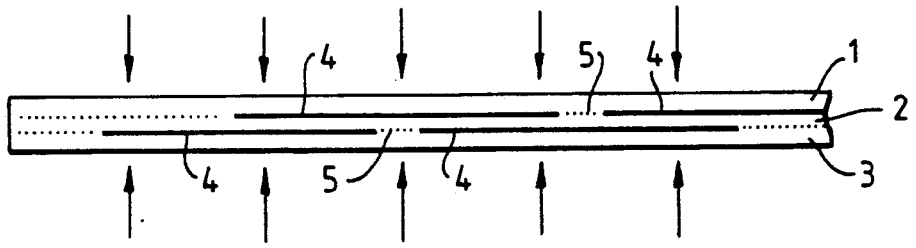
Fig.1 (PRIOR ART)
FIG. 1 shows the diffusion bonding of a three sheet pack.
Figure 2:
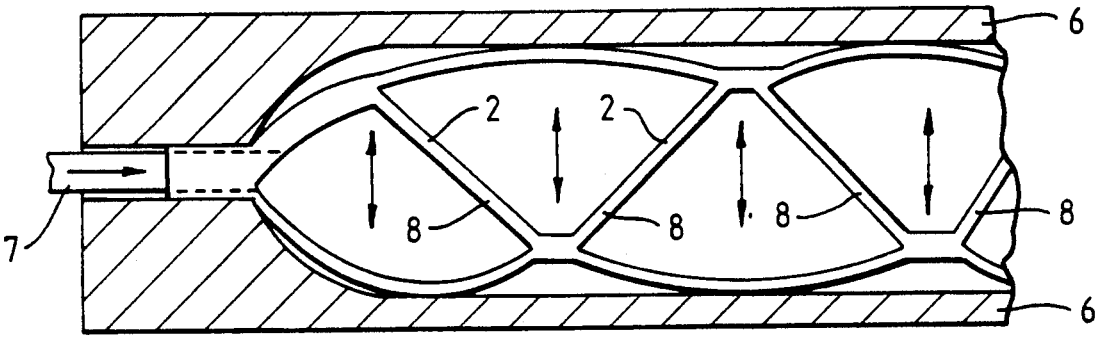
Fig.2. (PRIOR ART)
FIG. 2 shows the superplastic formation of a component from the pack of FIG. 1.
Figure 3:
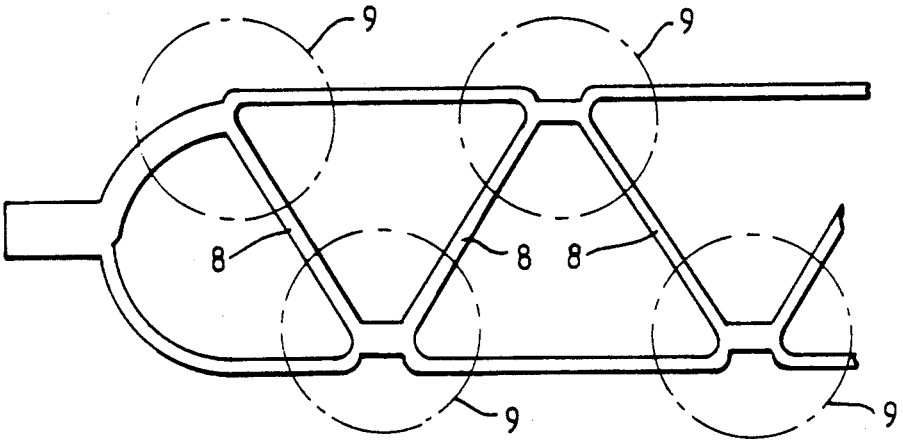
Fig.3. (PRIOR ART)
FIG. 3 shows the component produced by the diffusion bonding and superplastic forming processes shown in FIGS. 1 and 2.
Figure 4:
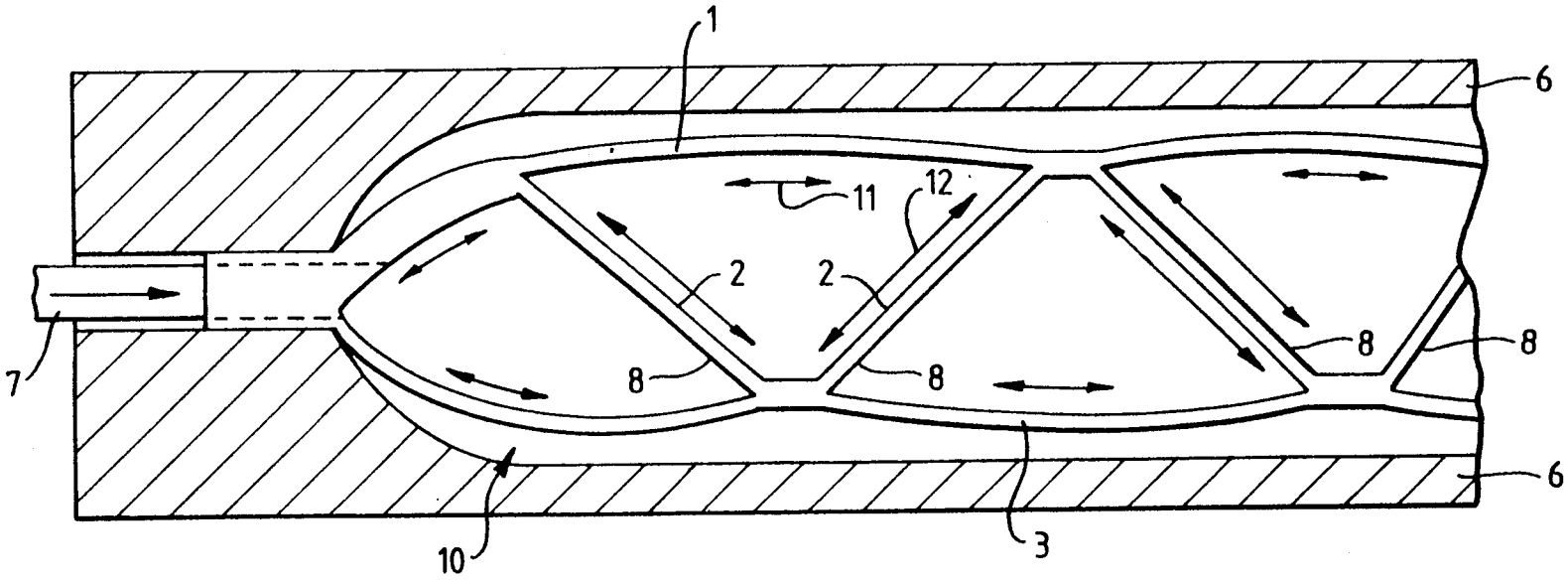
FIG. 4 shows the superplastic formation of a component in accordance with the method of the present invention.

The first stage of the forming process consists of laying three titanium alloy sheets 1, 2 and 3 one on top of the other to form a pack, the layers of the pack being selectively interlaid with stop-off material 4, as described with reference to FIG. 1. However, the materials of the sheets 1, 2 and 3 are selected or prepared so that the superplastic flow stress characteristic of the skin sheets 1 and 3 is higher than that of the core sheet 2, i.e., in terms of superplasticity, the skin sheets 1 and 3 are stiffer than the core sheet 2. A suitable ratio of skin sheet flow stress characteristic to core sheet flow stress characteristic is thought to be 3:1 or greater. The remainder of the forming process is the same as that described above with reference to FIGS. 1 to 3; although, as can be seen from a comparison of FIG. 4, the tendency of the skin sheets 1 and 3 to bow outwards at a faster rate in the regions where they are the greatest distance from the support walls 8 is greatly reduced or substantially eliminated. This is due to the higher flow stress characteristic of the skin sheet material relative to the core sheet material, as indicated by the difference in lengths of the double-headed arrows 11 and 12. As a consequence the quilting effect is substantially removed without the need for high skin to core sheet thickness ratios. Thus, the chemical milling process is rendered unnecessary or, at least, the amount of chemical milling required is reduced.

The different flow stress characteristics of the sheets 1, 2 and 3 can be achieved by several methods, such as using materials having the same base element but with different compositions and/or being subject to different material manufacturing process histories; using materials of similar chemical composition but modified by subsequent processing (for example heat treatment); or using different materials (for example steel for one sheet and titanium alloys for the other sheets). One suitable material which is known to have lower superplastic flow stress characteristics than conventional superplastic titanium alloys is available from the NKK Corporation of Japan under the name of SP-700. The material, for which a US patent application is to be made, is an alpha/beta titanium alloy which has the following chemical composition: 88.378% titanium, 0.002% hydrogen, 0.08% oxygen, 0.08% nitrogen, 2.0% iron, 2.0% molybdenum, 2.92% vanadium and 4.54% aluminium. An example of a conventional superplastic titanium alloy is titanium 6 Aluminium/4Vanadium alpha/beta alloy.

Obviously many other structures other than that described can be manufactured in accordance with the invention. For example, the pack may comprise four sheets—the two outer sheets having relatively high flow stress characteristics—which are interlaid with a pattern of stop-off material so that, when the gas is introduced into the component, an "X" core type structure is produced.

We claim:

1. A method for producing a structure comprising the steps of:

diffusion bonding at least two sheets of similar materials together in selected areas, said sheets having different chemical composition thereby having different flow stress characteristics; and superplastically forming the diffusion bonded sheets in a mold, said sheets being one of titanium and titanium alloys.

2. A method according to claim 1, wherein three sheets of material are used to form the structure, two of the sheets being one of titanium and titanium alloys having relatively high flow stress characteristics and forming in a manufactured structure respective outer surfaces thereof, and the other sheet having relatively low flow stress characteristics and extending in the manufactured structure between the respective outer surfaces to form supporting walls thereof, said high flow stress sheets being composed of a material different from said low flow stress sheet.

3. A method according to claim 1, wherein four sheets of material are used to form the structure, two of the sheets being one of titanium and titanium alloys having relatively high flow stress characteristics and forming in a manufactured structure respective outer surfaces thereof, and the other two sheets having relatively low flow stress characteristics and each extending in the manufactured structure from one of the respective outer surfaces to the other outer surface of said other two sheets to form supporting walls, said high flow stress sheets being composed of a material different from said low flow stress sheets.

4. A method for producing a structure comprising the steps of:

diffusion bonding at least two sheets of similar materials, said sheets having different chemical compositions, thereby having different flow stress characteristics; and superplastically forming the diffusion bonded sheets in a mold, said different flow stress characteristics being of at least a 3:1 ratio, said at least two sheets being one of titanium and titanium alloys.

5. A method for producing a structure comprising the steps of:

diffusion bonding at least two sheets of different materials together in selected areas, said at least two sheets having different flow stress characteristics, and superplastically forming the diffusion bonded sheets in a mold, one of said at least two sheets being one of titanium and titanium alloy, another of said at least two sheets being steel.

6. A method for producing a structure comprising the steps of:

diffusion bonding at least two sheets of different materials together in selected areas, said at least two sheets having different flow stress characteristics, said different flow stress characteristics being of at least a 3:1 ratio; and superplastically forming the diffusion bonded sheets in a mold, one of said at least two sheets being one of titanium and titanium alloy, another of said at least two sheets being steel.

* * * * *